United States Patent [19]

Thompson et al.

[11] 4,029,213

[45] June 14, 1977

[54] CRANE LOAD INDICATING ARRANGEMENT

[75] Inventors: Willie Ellis Thompson; Timothy John Archer Davis, both of Westcliff on Sea, England

[73] Assignee: Pye Limited, Cambridge, England

[22] Filed: Apr. 2, 1975

[21] Appl. No.: 564,307

[30] Foreign Application Priority Data

Apr. 10, 1974 United Kingdom ..... 15845/74

[52] U.S. Cl. ..... 212/39 MS; 340/267 C

[51] Int. Cl.[2] ..... B66C 13/48

[58] Field of Search ... 212/39; 340/267 C, 177 CA; 235/151.3; 214/2

[56] References Cited

UNITED STATES PATENTS

| | | | |
|---|---|---|---|
| 3,079,080 | 2/1963 | Mason | 212/39 MS |
| 3,586,841 | 6/1971 | Griffin | 212/39 R |
| 3,631,537 | 12/1971 | Zibolski | 212/39 MS |
| 3,638,211 | 1/1972 | Sanchez | 212/39 MS |
| 3,740,534 | 6/1973 | Kezer et al. | 340/267 C |

*Primary Examiner*—Lawrence J. Oresky
*Attorney, Agent, or Firm*—Frank R. Trifari; Bernard Franzblau

[57] ABSTRACT

A crane load indicator in which actual loading is determined by a strain transducer as a function of shear stress on a crane boom. A resultant actual loading signal is compared with a computed signal representative of the maximum crane loading for the prevailing conditions and the two signals are compared to provide an indication of available lifting capacity.

13 Claims, 5 Drawing Figures

CRANE LOAD INDICATING ARRANGEMENT

This invention relates to a load indicating arrangement for use with lifting apparatus such as cranes having a boom which is pivoted at one end for luffing movement by an hydraulic ram or other boom supporting means and is adapted to sustain a load at its other end. The load indicator comprises measuring and reference circuits for providing an indication or alarm in respect of the weight of the load and the available lifting capacity. The invention has a particular but non-exclusive application to mobile cranes of the above type having an extensible boom which can be slewed through the whole or part of a circle.

Such crane load indicating arrangements are known.

In two crane load indicating arrangements according to British patent specification No. 1,358,871, means are provided for producing a signal representative of the total turning moment of the boom about its luffing pivot in terms of the angle included between the luffing ram and the boom and the reaction sustained by the ram in supporting the boom and any load suspended from it. The pressure of the hydraulic fluid in the ram is a function of this reaction and is measured by a suitable pressure transducer. The total turning moment signal thus measured is compared with a computed reference signal representative of the maximum safe turning moment of the boom about its luffing pivot for the boom luff angle and load radius currently obtaining to produce a resultant output signal which can be utilised to provide an indication of available lifting capacity and to operate an alarm when the measured total turning moment signal bears a specified relationship to the computed reference signal.

In another prior crane load indicating arrangement described in British patent specification No. 1,295,342 a transducer is employed to produce a signal representative of the total bending moment of the boom resulting from the weight of the boom and the weight of any load suspended from it. Various circuits produce a plurality of signals, each associated with a respective boom section, which are representative of the extended lengths and weights of the boom sections, these signals being combined with the signal from the transducer to produce a plurality of signals representative of the actual bending moments on respective boom sections. Reference signals proportional, respectively, to predetermined maximum safe bending moments for the several boom sections are produced, and means are provided for comparing each of the reference signals with the signal representative of the actual bending moment on the corresponding boom section and for providing an indication when any of the actual bending moment signals exceeds a predetermined percentage of the corresponding reference signal.

According to the present invention, a load indicating arrangement for use with a crane or other lifting apparatus of the type specified comprises a strain transducer operatively connected to the boom at a location effective to produce on the transducer a strain which is a substantially linear function of the shear stress produced in the boom by the weight of that part of the boom between the said location and the outer end of the boom, together with the weight of any load suspended at said outer end.

In carrying out the invention, the load indicating arrangement can include means for comparing an output derived from the transducer output with a computed reference output representative of the maximum safe load that the lifting apparatus can withstand for the boom luff angle and/or load radius currently obtaining to provide an indication of available lifting capacity.

More specifically, the load indicating arrangement may comprise means for producing from said strain transducer a first output representative of the shear stress in the boom, means for producing a second output representative of the cosine of the angle between the axis of the boom and a substantially horizontal plane, means for combining the first and second outputs to produce a third output representative of the sum of the weight of that part of the boom between the transducer location and the outer end of the boom and the weight of any load suspended therefrom, means for producing a fourth output representative of the weight of the said part of the boom, means for combining said third and fourth outputs to produce a fifth output representative of the weight of the load, a law generator unit in respect of each mode of operation of the lifting apparatus, each unit being adapted to produce a sixth output representative of the maximum safe weight of load in the appertaining mode of operation for the load radius or boom luff angle currently obtaining, means for comparing said fifth and sixth outputs to provide a seventh, resultant, output representative of the actual weight of the load relative to the maximum safe weight of the load, and indicating means responsive to said seventh output.

It is expected that the use of a strain transducer in accordance with the invention will give a more accurate reproducibility of results as compared with prior load indicating arrangements. For instance, with load indicating arrangements using the pressure of hydraulic fluid in a luffing ram as a measure of total turning moment, it has been found in practice that an output representing total turning moment may not be always consistent for a given load and configuration of the lifting apparatus due to a variation of hydraulic pressure in the luffing ram. For example, the hydraulic pressure in the luffing ram when the boom is held at a given luff angle after having been raised from a lesser angle can differ from the hydraulic pressure in the luffing ram when the boom is held at the same luff angle after having been lowered from a greater angle. This variation of hydraulic pressure is attributed to frictional and other losses in the luffing ram. Ram pressure variations of this sort set a limit to the possible accuracy of a load indicating arrangement because available overall tolerances of the arrangement about a required degree of accuracy, as may be determined by government legislation, are largely taken up by these ram pressure variations so that considerable elaboration of the remainder of the arrangement, together with an elaborate calibration procedure, may can become necessary in order for the arrangement to be within the required degree of accuracy. With the present invention, random errors in the output from the strain transducer are less than those in the output from a transducer responsive to hydraulic pressure in the luffing ram, thereby affording a higher degree of accuracy or, alternatively, a simplification of the remainder of the arrangement and/or its calibration procedure.

A major advantage of shear stress measurement according to the invention is that said stress is theoretically constant in the longitudinal direction of the boom, so that the location of the transducer does not affect its output signal to the same extent as in the case of known arrangements.

In order that the invention and the manner in which it is to be performed may be more fully understood, an embodiment thereof will be described, by way of example, with reference to the accompanying drawings in which.

Figure 1:
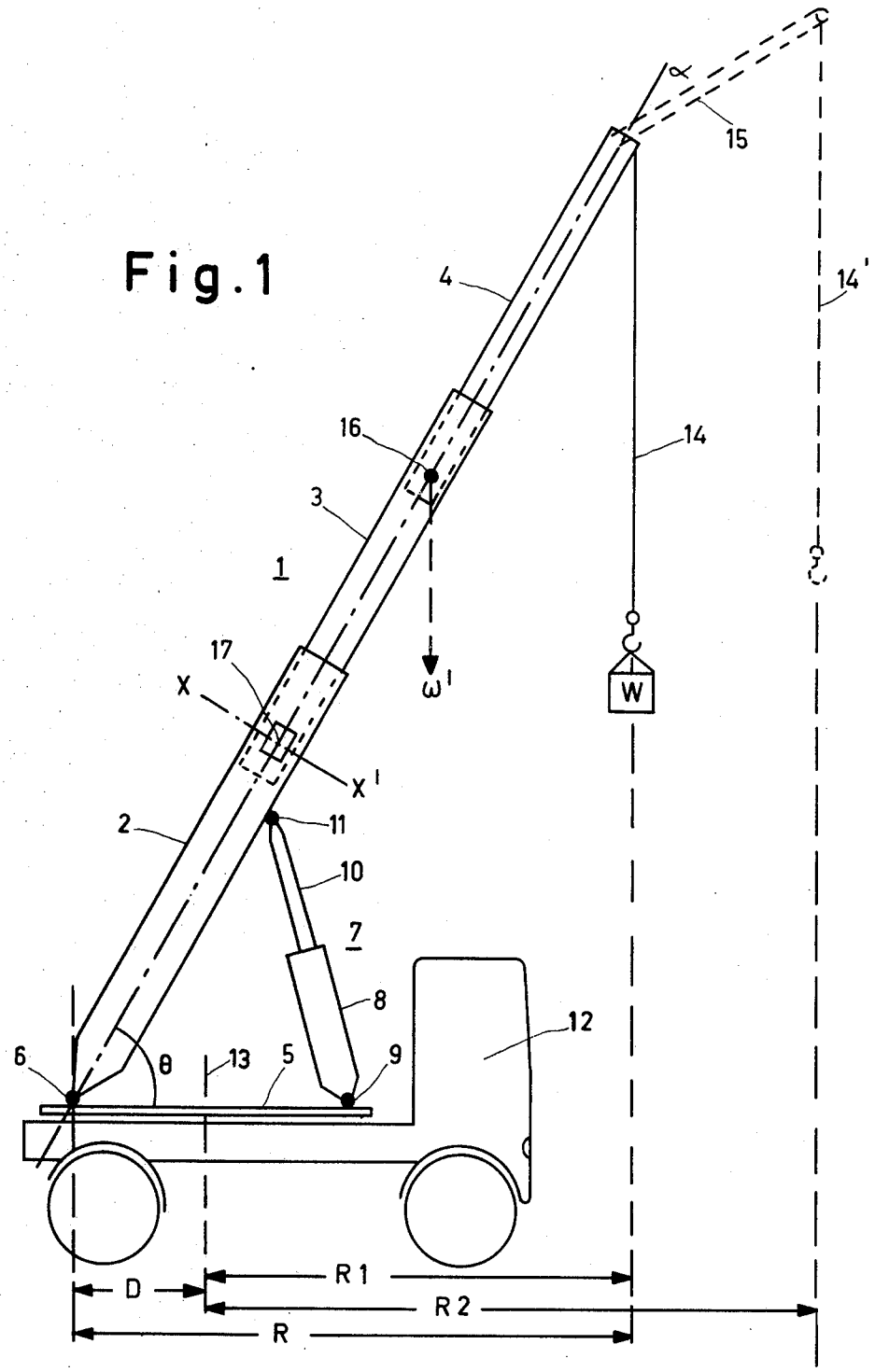
FIG. 1 is a diagrammatic representation of a mobile crane.

Referring first to FIG. 1, the mobile crane there shown has a boom, indicated generally by the reference numeral 1, which comprises a lower section 2, an intermediate section 3 slidable telescopically within the upper end of the section 2, and an upper section 4 slidable telescopically within the upper end of the section 3. Extension means such as an hydraulic ram (not shown in FIG. 1) is provided to position the section 3 with respect to the section 2 and to position the section 4 with respect to the section 3, so that the overall length of the boom 1 may be adjusted to any desired value between a maximum and a minimum limit.

The lower end of the boom section 2 is pivoted to a horizontal base unit 5 at a point 6 so as to permit luffing movement of the boom 1. An hydraulic luffing ram 7 has one end of its cylinder 8 pivoted to the base unit 5 at a point 9 and its piston rod 10, which extends through the other end of the cylinder 8, pivoted to the boom section 2 at a point 11. The longitudinal axis of the boom 1 makes an angle $\theta$ (the luff angle) with the horizontal, $\theta$ being variable by varying the extension of the luffing ram 7.

The base unit 5 is mounted on a road vehicle chassis 12 and is arranged for rotation with respect to the chassis about a vertical axis on a slewing centre 13.

For basic duties of the crane, a load W is suspended by a hoist rope 14 which passes over a sheave (not shown) at the outer end of the boom section 4 to a winding drum (also not shown). It will be seen that by varying the extension of the boom and/or the luff angle the horizontal distance R1 between the slewing centre 13 and the hoist rope 14 can be varied so as to permit the lifting of loads located within a range of radii from the slewing centre.

For fly duties of the crane, a fly jib 15, shown in broken outline in FIG. 1, is secured to the outer end of the boom section 4, and the hoist rope 14' passes over a sheave (not shown) at its outer end. For any combination of boom extension and luff angle, the horizontal distance R2 between the slewing centre 13 and the hoist rope 14' is greater than the corresponding value of R1.

The portion of the boom above the luffing ram pivot point 11 forms a true cantilever which is subject to the forces imposed by its own weight and by the load suspended from the hoist rope.

In a crane equipped for basic duties (i.e. without fly jib), consider the shearing force at a cross-section plane of the boom section 2 located above the pivot point 11, as indicated by the broken line $XX^1$ in FIG. 1. The forces acting on the boom are the weight $w'$ of the portion of the boom beyond the cross-section plane $XX^1$, acting vertically downwards through its centre of gravity 16 and the weight W of the load suspended from the hoist rope 14. The shearing force S across the section $XX^1$ is given by $$S = w' \cos \theta + W \cos \theta.$$

It can be seen from FIG. 1 that as the extension of the boom is varied, the weight $w'$ will also vary since a greater or lesser proportion of the sections 3 and 4 of the boom will lie beyond the cross-section plane $XX^1$. Hence $w'$ will vary with the length L of the boom according to a fixed law function F, and if $w$ is the total (constant) weight of the boom, then $w' = F(L)w$.

Therefore the shearing force $S = [W + F(L)w] \cos \theta$.

A strain transducer 17 is secured to the boom at the location of the section $XX^1$.

Figure 2:
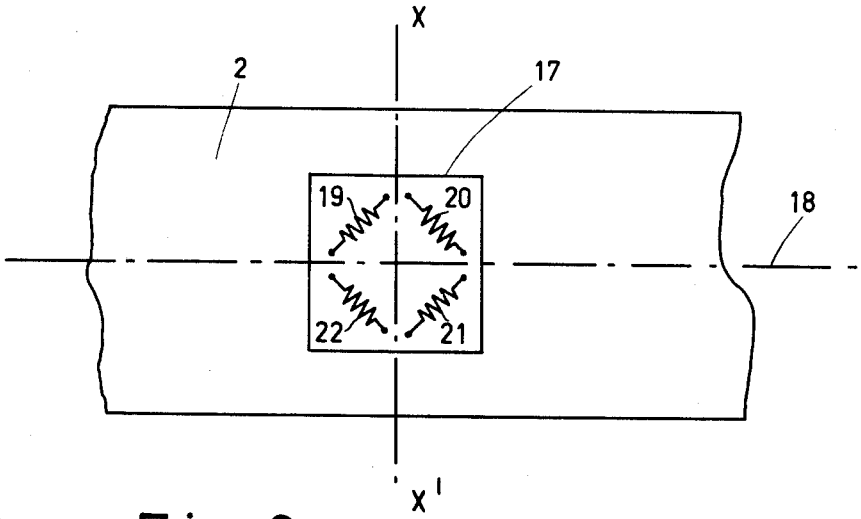
FIG. 2 illustrates a first transducer arrangement according to the invention for use with the crane of FIG. 1.
Figure 3:
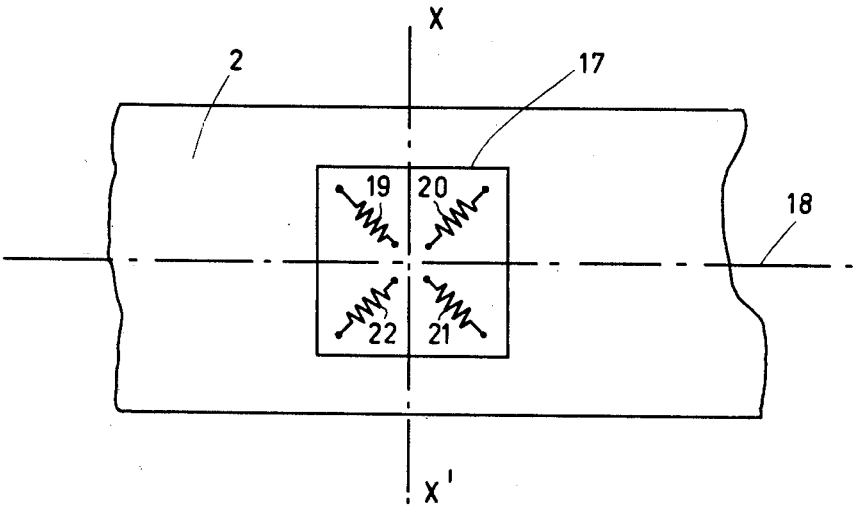
FIG. 3 illustrates an alternative transducer arrangement according to the invention.

The transducer 17 comprises an array of strain gauge elements so arranged as to provide an output dependent on the shearing stress but substantially independent of the bending moment in the boom. A suitable arrangement is illustrated in FIG. 2 which is a side elevation of a portion of the lower boom section 2 containing the cross-section plane $XX^1$. The longitudinal axis of the boom is denoted by the chain dotted line 18. The transducer 17 comprises strain gauge resistive elements 19, 20, 21 and 22 affixed to the boom in a square formation with one diagonal of the square lying along the axis 18 and the other diagonal lying along the cross-section plane $XX^1$. The elements 19 to 22 are connected (in obvious manner) in a bridge circuit so that the amount of unbalance is a measure of the sharing force at the cross-section plane $XX^1$. The bending moment of the boom section 2 subjects the elements 19 and 20, mounted above the axis 18 to a tensile force and elements 21 and 22 mounted below the axis 18 to a compressive force. Since the elements 19 and 20 are connected in opposite arms of the bridge, as are also the elements 21 and 22, the changes in the resistance of the elements caused by the bending moment of the section 2 do not affect the bridge balance. An alternative method of disposing the strain gauge elements 19 to 22 is illustrated in FIG. 3. In this instance, these elements, which are in a cross formation with two elements disposed on each side of the axis 18 and two elements disposed on each side of the plane $XX^1$, would also be connected to form a bridge circuit in which elements 19 and 20 are in two adjacent arms and the elements 21 and 22 are in the other two adjacent arms.

Figure 4:
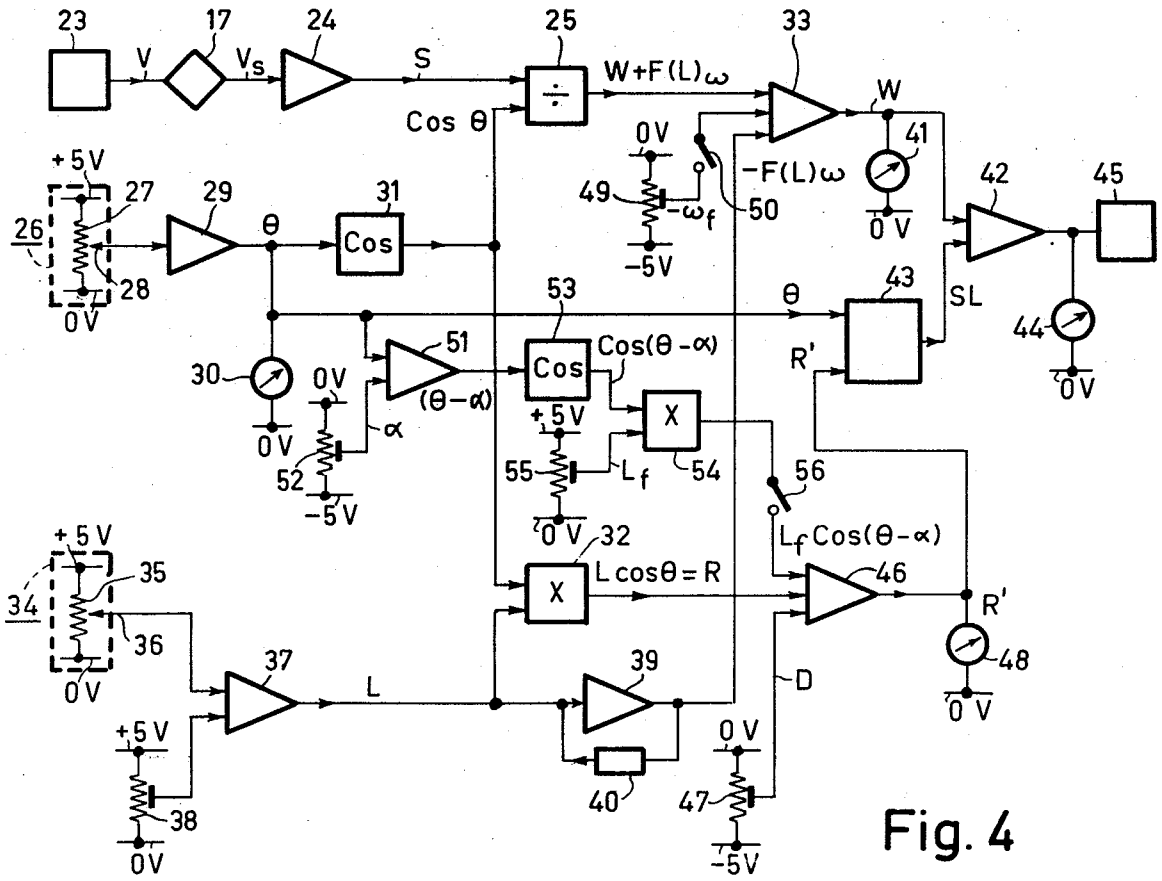
FIG. 4 is a block schematic diagram of a load indicating arrangement according to the invention.

Consider now the load indicating arrangement shown in FIG. 4. This arrangement first will be described in relation to basic duties of the crane, and additional features required in respect of fly duties will follow.

Referring to FIG. 4, a reference signal generator 23, for example a 700 Hz square wave oscillator, provides a stable signal V of constant voltage. This signal V is supplied to the transducer 17 which, mounted on the boom 1 as aforesaid, produces an output $V_s$ proportional to the shearing stress in the boom. The output $V_s$ is applied to a buffer amplifier 24 whose output S is thus representative of the shear stress (i.e. $S = [W + F(L)w] \cos \theta$) and is applied as a dividend input to an analogue divider unit 25.

A luff angle transducer 26 comprises a potentiometer mounted for movement with the boom 1 and having a resistive track 27 connected across a stabilised reference voltage supply (e.g. 5 volts). It is assumed for the purposes of the present description that the load indicating arrangement is energised by a 5 volts stabilised reference supply, but it is to be understood that this voltage is given only as an example and that the actual voltage supply required depends upon the type of circuit elements used in the load indicating arrangement. A slider 28 is gravity actuated, e.g. by a pendulum, so that it moves over the track 27 as the luff angle changes when the extension of the luffing ram 7 is varied. The slider 28 is connected to an input terminal of a buffer amplifier 29 which produces an output $\theta$ proportional to the boom luff angle $\theta$. This output $\theta$ may be used to drive a meter 30 which is scaled in terms of luff angle, and is also fed to an input terminal of a mode unit 43 to be described hereinafter. The output $\theta$ of amplifier 29 is also supplied as an input to a cosine law generator unit 31. This unit 31 is preferably of a type in which the slope of its input/output characteristic is modified stepwise in accordance with changes in its input amplitude so as to produce an overall characteristic comprising a plurality of sections of differing slopes and approximating closely to a cosine law. The resultant output cos $\theta$ from unit 31 is thus proportional to the cosine of the luff angle $\theta$ and its connected as a first input to an analogue multiplier unit 32 and as the divisor input to the analogue divider unit 25.

Since the dividend input to unit 25 is representative of $[W + F(L)w]$ cos $\theta$, its output represents $[W + F(L)w]$. This output is fed as one input to a summing amplifier 33.

A boom extension sensor 34 comprises a potentiometer having a resistive track 35 connected across the 5V stabilised reference voltage supply and a slider 36 mechanically coupled to the boom so as to be driven over the track as the boom extension is varied between its minimum and maximum limits. The voltage at the slider, corresponding to the degree of extension, is fed to an input of a summing amplifier 37. A potentiometer 38, also connected across the reference voltage supply, is preset to provide a voltage at its slider proportional to the boom length at minimum extension, which voltge is fed to a further input of amplifier 37. The amplifier output L is therefore representative of the actual length of the boom. This output L is fed as a second input to the analogue multiplier unit 32.

The output of the amplifier 37 is also fed as an input to an operational amplifier 39 provided with a feedback network 40 connected between its output and input terminals. The transfer characteristic of the network 40 corresponds to the function F relating the weight of the part of the boom between the plane $XX^1$ and the outer end of the boom to the actual length L of the boom. The gain of the amplifier 39 is arranged to be proportional to the weight w of the boom so that the magnitude of its output is representative of F(L)w, and its polarity is arranged to be opposite to that of the output $W + F(L)w$ from the unit 25 which is applied as a first input to the summing amplifier 33. The output of amplifier 39 is applied as a second input to the amplifier 33 which thus receives a net input $W + F(L)w - F(L)w$ and produces an output W which is proportional to the weight of the load.

The output W may be applied to a meter 41 scaled in terms of hook load, and is also applied as an input to a summing amplifier 42.

A further output SL, which is produced by the mode unit 43 to be described hereinafter, is also applied as an input to the summing amplifier 42. This output SL is proportional to the weight of the maximum safe load which the crane is permitted to lift for the load radius and/or luff angle that currently obtain in any particular mode of operation. The output SL is arranged to have a polarity opposite to that of the output $W$ so that the net input to the amplifier 42 is equal to $(SL-W)$. When the crane is lifting its maximum safe load in a particular mode of operation, $SL = W$ and the net input is zero. The output of amplifier 42 is consequently also zero and is indicated at the calibration point of a safe working load meter 44 connected to the output terminal of the amplifier 42, the meter zero having been offset mechanically to this calibration point. Increase of load above the rated maximum $(W>SL)$ will produce a net input of one polarity and a corresponding output from the amplifier 42 which will drive the meter 44 into an overload region of its scale. Loads less than the rated maximum $(SL>W)$ will produce a net input and corresponding output from the amplifier 42 of the opposite polarity, driving the meter 44 into a safe region of its scale and so indicating available lifting capacity.

The output of the amplifier 42 may also be applied to an alarm unit 45 which is adapted to produce an audible and/or visual alarm when the maximum safe load is reached or exceeded. The alarm unit 45 may include means to provide a preliminary warning signal when the load exceeds a predetermined percentage of the maximum safe load, and/or trip circuits to cut off power to the hoist motor in the event of an overload.

As previously described, the output cos $\theta$ provided by the unit 31 and the boom length output L from the amplifier 37 are applied as respective inputs of an analogue multiplier unit 32. The output R of unit 32 is therefore proportional to L cos $\theta$, which is the horizontal distance between the boom pivot point 6 and the hoist rope 14 (see FIG. 1). However, for basic duties, the crane is rated in terms of the radius from the slewing centre 13.

The output R from the unit 32 is applied as a first input to a summing amplifier 46. A preset potentiometer 47 connected across a −5v reference voltage supply produces an output D proportional to the distance between the pivot point 6 and the slewing centre 13. The output D, which is arranged to be of opposite polarity to the output R, is applied as a second input to the amplifier 46, whose output R′ equals R−D and is proportional to the radius of the load from the slewing centre. The output R′ of the amplifier 46 may be applied to a meter 48 scaled in terms of load radius, and is further applied to an input to the mode unit 43.

When a fly jib 15 is fitted, as shown in broken outline in FIG. 1, its weight $w_f$ causes an increase in the shear stress at the plane $XX^1$, which then becomes $$S' = [W + F(L)\ w + w_f] \cos \theta$$

Hence the output from the unit 25 becomes $W + F(L)w + w_f$. A potentiometer 49 connected across a −5V stabilised reference supply is preset to produce at its slider a voltage proportional to $-w_f$. This voltage $-w_f$ is applied via a switch 50, closed only when the fly jib is fitted, as a third input to the summing amplifier 33 so as to cancel the $+w_f$ component of the input from unit 25. As a result, the output W remains proportional to the weight of the load, as in the basic arrangement.

A further effect of the fly jib is to increase the load radius by a distance equal to the horizontal projection of the jib length $L_f$. It may be seen from FIG. 1 that this distance is equal to $L_f \cos(\theta - \alpha)$, where $\alpha$ is the angle between the axis of the boom and the axis of the fly jib. The output $\theta$ from the amplifier 29 is applied as a first input to a summing amplifier 51. A potentiometer 52 connected across the −5v reference voltage supply is preset to give a voltage representative of the angle $\alpha$. This voltage is of opposite polarity to the output $\theta$ and is fed as a second input to the amplifier 51, whose output is therefore proportional to $(\theta - \alpha)$. The output of amplifier 51 is applied as an input to a cosine law generator unit 43, which is similar to the unit 31. The unit 53 produces an output representative of $\cos(\theta - \alpha)$ which is fed as a first input to an analogue multiplier unit 54. A potentiometer 55 connected across the +5V reference voltage supply is preset to produce at its slider a voltage representative of the length $L_f$ of the fly jib. This voltage is applied as a second input to the multiplier unit 54 which therefore produces an output representative of $L_f \cos(\theta - \alpha)$. This output is applied via a switch 56, closed only when the fly jib is fitted, as a further input to the summing amplifier 46 whose output R′ is then representative of the radius of the load from the slewing centre when the crane is performing fly duties.

The mode unit 43, which will now be described with reference to FIG. 5, comprises a plurality of similar law generator units, each adapted to provide an output which varies according to a predetermined law. One law generator unit is provided for each separate mode of operation which the crane can perform, and is preset to a law corresponding to the manufacturer's rating curve for that mode of operation. Means are provided to select the one law generator unit corresponding to the mode of operation being performed.

Figure 5:
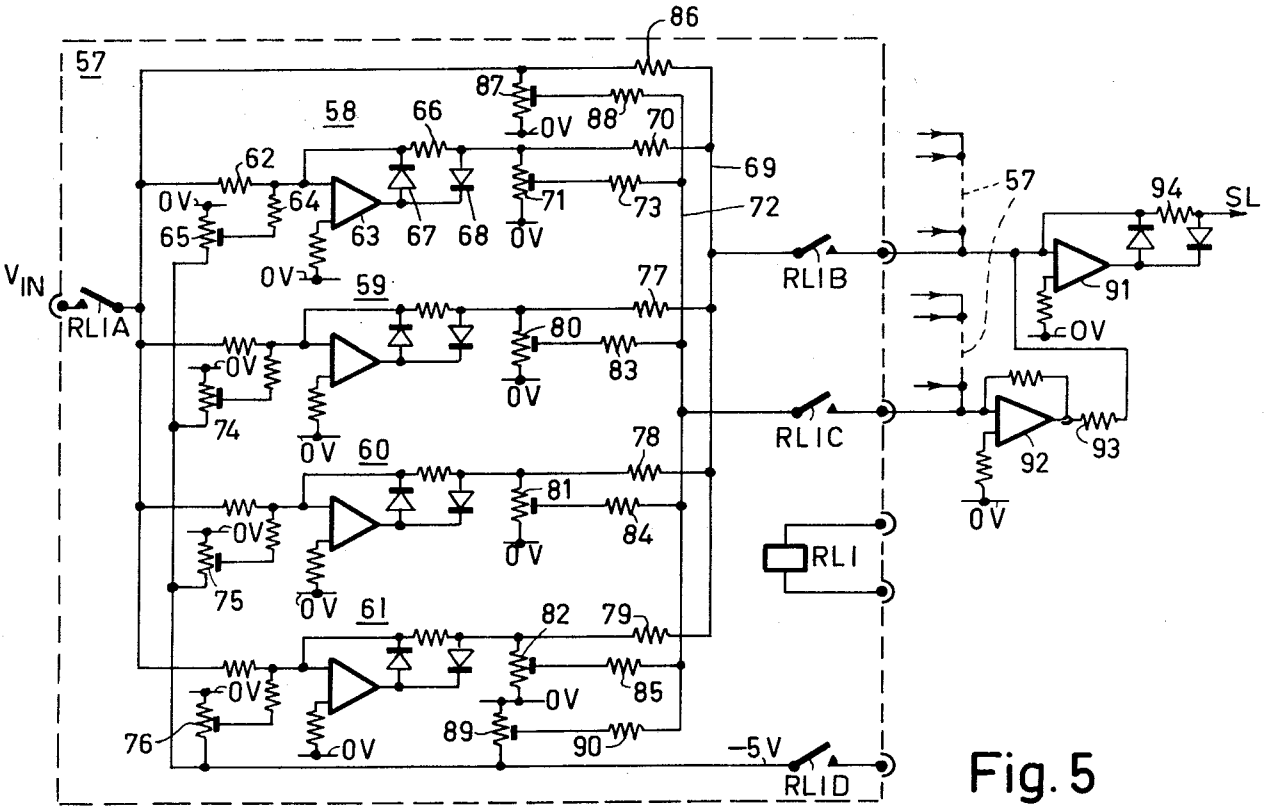
FIG. 5 is a schematic diagram of a law generator unit for use in the arrangement of FIG. 4.

Referring to FIG. 5, a law generator unit 57 is carried on a printed circuit board indicated by the broken line rectangle. The circuit of this unit comprises a plurality of similar threshold amplifiers indicated generally by the references 58, 59, 60 and 61. A positive voltage input $V_{IN}$, which can be either the luff angle output from amplifier 29 or the radius output from amplifier 46 (see FIG. 4) is applied to each threshold amplifier. Considering first the threshold amplifier 58, the input $V_{IN}$, which passes through a contact RLIA of a relay RLI which is energised when the particular unit 57 is in use, is fed via an input resistor 62 to an input terminal of an amplifier 63. A negative bias voltage is fed to the same input terminal via a resistor 64 from the slider of a preset potentiometer 65 (Break 1) connected between a −5V reference supply (via relay contact RLID) and ground. The output terminal of amplifier 63 is connected to the same input terminal thereof via a feedback circuit comprising a resistor 66 and two diodes 67 and 68. The arrangement is such that if the magnitude of the positive voltage input $V_{IN}$ is less than the magnitude of the negative bias voltage, giving a net negative input to the amplifier 63, the amplifier output tends to go positive. This causes the diode 67 to conduct. Since the input to the amplifier 63 is a virtual ground, the output is therefore clamped substantially at ground potential (plus the voltage developed across the low forward resistance of the diode 67) for all values of the input voltage $V_{IN}$ less than the value of the bias voltage set by the potentiometer 65.

If the input voltage $V_{IN}$ is greater than the bias voltage, thus giving a net positive input, the output of amplifier 63 goes negative. Diode 67 is cut off, but diode 68 conducts, connecting resistor 66 as a feedback resistor between the output and input terminals of the amplifier 63.

Therefore, as the input voltage $V_{IN}$ varies from zero to its maximum, say +5V, the output of the threshold amplifier 58 remains substantially zero until the input voltage $V_{IN}$ reaches a value (the threshold value) determined by the setting of the potentiometer 65. Thereafter, the output increases linearly with further increase of the input voltage $V_{IN}$, with a negative polarity and at a rate determined by the relative values of the feedback resistor 66 and the input resistor 62.

The output of the threshold amplifier 58 is applied to a first summing junction 69 via a resistor 70, and also to one end of a Slope 1 potentiometer 71. The slider of the potentiometer 71 is connected to a second summing junction 72 via a resistor 73.

The threshold amplifiers 59, 60 and 61 are similar to the amplifier 58 just described and are provided with respective threshold-setting potentiometers 74, 75 and 76. Their outputs are applied to the first summing junction 69 via respective resistors 77, 78 and 79, and also to respective potentiometers 80, 81 and 82. The sliders of the potentiometers 80, 81 and 82 are connected via respective resistors 83, 84 and 85 to the second summing junction 72.

The input voltage $V_{IN}$ is applied to the first summing junction 69 via a resistor 86 and also to a potentiometer 87, whose slider is connected to the second summing junction 72 via a resistor 88.

A potentiometer 89 is connected between ground and the −5V reference voltage supply and its slider is connected to the second summing junction 72 via a resistor 90.

The first summing junction 69 is connected via relay contact RLIB to an input terminal of an amplifier 91 contained in the mode unit 43 (FIG. 4). The second summing junction 72 is connected via relay contact RLIC to an input terminal of an inverting amplifier 92 whose output terminal is connected via a resistor 93 to the said input terminal of amplifier 91.

The operation is as follows: ignoring for the present the second summing junction 72 and the amplifier 92, the output of the amplifier 91 depends on the contributions to the first summing junction from the input voltage $V_{IN}$ via resistor 86 and from the threshold amplifiers 58, 59, 60 and 61.

As the input voltage $V_{IN}$ increases from zero, current flows through resistor 86, but until the input voltage $V_{IN}$ reaches the respective break points of the threshold amplifiers, their outputs all remain zero. Consequently, the output of the amplifier 91 initially increases linearly with the input voltage $V_{IN}$ at a rate determined by the relative values of a feedback resistor 94 and the resistor 86, and with a negative polarity.

When the input voltage $V_{IN}$ reaches the first break point, determined by the setting of the potentiometer 65, the first threshold amplifier 58 commences to give an output which increases linearly with a further increase of the input voltage $V_{IN}$, and which is negative going. The current flowing via resistor 70 into the input terminal of the amplifier 91 is therefore of opposite polarity to the current flowing via resistor 86. The net effect is that the rate of rise of input current with an increase of the input voltage $V_{IN}$ is reduced for values of the input voltage $V_{IN}$ above the first break point. Therefore, the rate of increase of the output of the amplifier 91 is similarly reduced.

As the input voltage $V_{IN}$ continues to increase it reaches successively the second, third and fourth break points determined respectively by the settings of the potentiometers 74, 75 and 76. At these points, the threshold amplifiers 59, 60 and 61 commence in turn to contribute to the input current to the amplifier 91.

The result is that a curve relating the output of the amplifier 91 to the input voltage $V_{IN}$, neglecting the amplifier 92, comprises five linear sections whose slopes are progressively less. The break points at which the slope changes are selected by adjustment of the potentiometers 65, 74, 75 and 76.

Turning now to summing junction 72 and amplifier 92, it will be seen that the inputs to this junction comprise a fraction of the input voltage $V_{IN}$ chosen by adjustment of the potentiometer 87 and fractions of the outputs of the threshold amplifiers 58, 59, 60 and 61 selected respectively by adjustment of the potentiometers 71, 80, 81 and 82. Consequently, the curve relating the output of amplifier 92 to the input voltage $V_{IN}$ comprises five linear sections whose slopes are progressively less, and which individually are less than or equal to the slopes of the sections of the corresponding curve for the amplifier 91. The break points of the two curves are identical.

Since the output of the amplifier 92 is applied to the input terminal of the amplifier 91, the overall output of the latter amplifier is the difference between the two curves aforesaid. Consequently, the overall characteristic is a curve comprising five linear sections, both the slopes of the individual sections and the break points at which the slopes change being adjustable. In addition, the DC level of the characteristic may be varied by adjustment of the potentiometer 89, which modifies the current into the summing junction 72.

The various potentiometers are adjusted to produce an overall characteristic which matches within close limits a crane rating curve.

A law generator unit 57 is provided for each separate rating curve. Each summing junction 69 is connected via its respective relay contact RLIB to the input terminal of the amplifier 91, and each second summing junction 72 is connected via its respective relay contact RLIC to the input terminal of the amplifier 92. Selection circuits within the mode unit 43 ensure that only one of the relays such as relay RLI is energised at any one time, so that only one of the law generator units 57 is operational.

The selection circuits are arranged to energise the particular law generator unit appropriate to the mode of operation which the crane is being used in, and may be automatic in operation. For example, sensors may be provided to detect when the outrigger booms are extended and blocked up. Only when the outrigger sensors are operated will a law generator for blocked modes of operation be brought into circuit. If the sensors are not operated, a law generator appropriate to free-on wheel modes of operation will be selected.

Similarly, for cranes whose fly jib duty ratings are over-ridden by the main radius duty ratings for certain combinations of luff angle and boom extension, the radius and luff angle will be supplied to the selector circuits, and the law generator unit selected will depend on the values of these signals.

The radius output provided by the amplifier 46 (FIG. 4) is supplied to the mode unit 43 and is connected to the inputs of those law generator units 57 which are selected when the crane is performing radius-related modes of operation. Similarly, the luff angle output $\theta$ provided by the amplifier 29 is connected to the inputs of those units which are selected for angle-related modes of operation. In each case, the connection is via the relay contact RLIA.

What is claimed is:

1. A crane load indicating arrangement for use with cranes having a boom which is pivoted at one end for luffing movement by a boom supporting means and is adapted to support a load at its other end, comprising measuring and reference circuits for providing an indication of the additional available lifting capacity a strain transducer adapted to be symmetrically mounted on the boom at a location for measuring only the shear stress in the boom but substantially independent of any bending stress in the boom at said boom location, the strain transducer supplying a first output signal to the measuring and reference circuits which is proportional to the shear stress produced in the boom by the weight of that part of the boom between the said location and the outer end of the boom, together with the shear stress produced by the weight of any load suspended at said outer end of the boom.

2. A load indicating arrangement as claimed in claim 1, characterized in that the measuring and reference circuits include means for producing a second output signal representative of the cosine of the angle $\theta$ between the axis of the boom and a substantially horizontal plane, means for combining the first and second output signals to produce a third output signal representative of the sum of the weight of that part of the boom between the transducer location and the outer end of the boom and the weight of any load suspended therefrom, means for producing a fourth output signal representative of the weight of the said part of the boom, means for combining said third and fourth output signals to produce a fifth output signal representative of the weight of the load, a law generator unit for each mode of operation of the crane, each law generator unit being adapted to produce a sixth out signal representative of the maximum safe weight of load in the appertaining mode of operation for the load radius or boom luff angle currently obtaining, means for comparing said fifth and sixth output signals to provide a seventh output signal representative of the actual weight of the load relative to the maximum safe weight of the load, and indicating means responsive to said seventh output signal.

3. An arrangement as claimed in claim 2 further comprising angle sensing means for producing an eighth output signal representative of boom luff angle $\theta$, and wherein said second output signal producing means includes a cosine law generator unit which is responsive to said eighth output signal to produce said second output signal.

4. An arrangement as claimed in claim 2 further comprising boom length sensing means for producing a ninth output signal representative of boom length, and wherein said fourth output signal producing means includes feedback circuit means responsive to said ninth output signal to produce said fourth output signal.

5. An arrangement as claimed in claim 4 further comprising means responsive to said second and ninth output signals to produce a tenth output signal representative of the horizontal distance between the boom pivot point and the load.

6. An arrangement as claimed in claim 5 further comprising means for producing and eleventh output signal representative of the horizontal distance between the boom pivot point and the slewing centre of the crane, and means for combining said tenth and eleventh output signals to produce a twelfth output signal representative of load radius.

7. An arrangement as claimed in claim 6, characterized in that for modes of operation involving radius related duties, each law generator unit concerned is responsive to said twelfth output signal, whereas for modes of operation involving angle related duties, each law generator unit concerned is responsive to an output signal representing boom luff angle.

8. An arrangement as claimed in claim 2 further comprising means for modifying the value of said fourth output signal as a function of a further signal determined by the effect of the fly jib when fitted.

9. An arrangement as claimed in claim 6 further comprising means for modifying the value of said twelfth output signal in response to a further signal determined by the effect of the fly jib when fitted.

10. An arrangement as claimed in claim 1 wherein said strain transducer comprises four strain gauge resistive elements affixed to the boom in a square formation with one diagonal of the square lying along the axis of the boom and the other diagonal of the square lying along a cross-section plane of the boom, the resistive elements being connected in a bridge circuit so that the amount of bridge unbalance will be a measure of the shearing force at the cross-section plane of the boom.

11. An arrangement as claimed in claim claim 1 wherein said strain transducer comprises four strain gauge resistive elements affixed to the boom in a cross formation with two elements disposed on each side of the axis of the boom and two elements disposed on each side of a cross-section plane of the boom, the resistive elements being connected in a bridge circuit in which the two elements on one side of the boom axis are in two adjacent bridge arms and the two elements on the other side of the boom axis are in the other two adjacent bridge arms whereby the bridge unbalance will measure the shear force at said cross-section plane.

12. A safe load indicator for a crane having a pivotally supported boom and boom supporting means comprising, a strain transducer adapted to be symmetrically mounted on the boom at a location effective to produce only a shear stress on the transducer by cancellation of any boom bending forces occurring at said boom location, said strain transducer being adapted to derive a first signal proportional only to the shear stress produced in the boom due to the weight of the boom and the weight of a load supported by the boom, boom angle sensor means for deriving a second signal corresponding to the boom luff angle $\theta$, boom length sensor means for deriving a third signal corresponding to boom length, means responsive to said second signal for deriving a fourth signal corresponding to the cosine of the boom luff angle, circuit means responsive to said first, third and fourth signals for deriving a fifth signal corresponding to the weight of the load only, law generator unit means for deriving a sixth signal corresponding to the maximum safe weight for the load for a given mode of operation of the crane, means for comparing said fifth and sixth signals to derive a seventh signal indicative of the available lifting capacity of the crane, and indicator means responsive to said seventh signal.

13. A safe load indicator as claimed in claim 12 further comprising means for deriving an eighth signal corresponding to the horizontal distance D between the boom pivot point and the slewing center of the crane base unit, means responsive to said third and fourth signals for deriving a ninth signal corresponding to the horizontal distance between the boom pivot point and the load, means for combining said eighth and ninth signals to derive a tenth signal corresponding to the radius of the load from the slewing center, and means for coupling said second and tenth signals to a control input of said law generator unit means.

* * * * *

UNITED STATES PATENT AND TRADEMARK OFFICE

CERTIFICATE OF CORRECTION

PATENT NO. : 4,029,213

DATED : June 14, 1977

INVENTOR(S) : WILLIE E. THOMPSON ET AL

It is certified that error appears in the above-identified patent and that said Letters Patent are hereby corrected as shown below:

IN THE CLAIMS

Claim 2, line 17, "out signal" should read --output signal--;

Claim 6, line 2, "and eleventh" should read --an eleventh--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*